US006852185B2

(12) United States Patent
Sanger

(10) Patent No.: US 6,852,185 B2
(45) Date of Patent: Feb. 8, 2005

(54) METHOD OF SECURING SHINGLES TO BUILDING ROOFS

(76) Inventor: Wallace D. Sanger, 11333 Acme Rd., Wellington, FL (US) 33414

( * ) Notice: Subject to any disclaimer, the term of this patent is extended or adjusted under 35 U.S.C. 154(b) by 0 days.

(21) Appl. No.: 10/331,819

(22) Filed: Dec. 30, 2002

(65) Prior Publication Data

US 2004/0123932 A1 Jul. 1, 2004

(51) Int. Cl.[7] ..... B04B 1/00
(52) U.S. Cl. ..... 156/71; 52/745.21; 52/746.11
(58) Field of Search ..... 52/23, 41, 57, 52/90.1, 90.2, 302.1, 408, 409, 411, 518, 745.05, 745.06, 745.21, 746.1, 746.11, 749.12; 156/71, 91, 92

(56) References Cited

U.S. PATENT DOCUMENTS 4,028,450 A * 6/1977 Gould ..... 264/45.5
5,951,796 A * 9/1999 Murray ..... 156/78

OTHER PUBLICATIONS

FRSA & NTRMA Model Tile Specifications System Three.
POLYPRO® AH–160 Roof Tile Adhesive Installation Recommendations for Broward County.

* cited by examiner

*Primary Examiner*—Sue A. Purvis
*Assistant Examiner*—Sing P. Chan
(74) *Attorney, Agent, or Firm*—Frank L. Kubler

(57) ABSTRACT

A method of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet abutment face and a shingle sheet display face, includes the steps of: depositing at least one first anchoring line of the adhesive onto the underlayment substantially parallel to the roof lower edge, the first anchoring line being spaced upwardly from the roof lower edge a distance not more than the shingle sheet width; placing a first series of the shingle sheets onto and in series along the at least one first anchoring line so that the first series of the shingle sheets extend substantially to the roof lower edge.

14 Claims, 3 Drawing Sheets

METHOD OF SECURING SHINGLES TO BUILDING ROOFS

BACKGROUND OF THE INVENTION

1. Field of the Invention

The present invention relates generally to the field of building construction methods. More specifically the present invention relates to a method of placing and securing shingle sheets, whether in the form of individual shingles or groups of shingles, to a roof underlayment using a polyurethane adhesive rather than nails, resulting in stronger attachment and permitting more rapid, efficient and reliable installation. The preferred method of installing shingle sheets onto a sloped roof, such as a peaked roof, includes the steps of depositing at least one first line of the adhesive onto the underlayment substantially parallel to the roof lower edge, the first line being spaced upwardly from the roof lower edge a distance equal to or less than the width of one of the shingle sheets; placing a laterally adjacent to or laterally overlapping first series of shingle sheets firmly onto the at least one first line of adhesive so that the shingle sheets extend substantially to the roof lower edge; depositing at least one second line of adhesive onto the underlayment substantially parallel to the roof lower edge spaced upwardly from the first series of shingle sheets a distance equal to or less than the width of one of the shingle sheets; placing a laterally adjacent to or laterally overlapping second series of shingle sheets firmly onto the at least one second line of adhesive so that the second series of shingle sheets overlaps upper ends of the first series of shingle sheets. A first interconnecting line of adhesive preferably is deposited onto the upper ends of the first series of shingle sheets so that the overlapping portions of the second series are adhered to the first series upper ends. The second series of shingle sheets preferably is staggered relative to the first series. The second step is repeated until the roof is covered to the roof peak or upper end with multiple series of shingle sheets.

It is preferred that the adhesive be deposited in lines because this achieves maximum adhesion. Alternatively a series of discrete paddies of adhesive are deposited onto the underlayment, in place of the lines of adhesive. Still another alternative is depositing scattered or randomly located discrete paddies of adhesive over the entire sheet coverage area of the underlayment.

2. Description of the Prior Art

There have long been methods of securing shingles and shingle sheets onto roof underlayment systems. These methods have always involved driving nails or tacks through the shingles, through the underlayment and into underlying plywood sheets. Problems with these traditional shingle securing methods have been that they make new roof construction, or re-roofing, costly in man-hours and they result in marginally adequate and unreliable shingle attachment. Still another problem has been that a certain level of diligence and responsibility are required for securing shingle sheets with nails. Several nails are needed to hold down each shingle sheet, and these nails must be positioned appropriately relative to the sheet edges for proper anchoring, and all of the nails should be driven entirely into the roof so that the nail heads rest flat against the sheet for maximized strength and minimized play during high winds. Finally, diligence and responsibility must be exercised in driving the proper number of nails into each shingle sheet. Rushed, careless or inadequately skilled workers may not perform these tasks completely and thus may produce a roof which does not withstand wind requirements, which soon leaks, and which does not last for a warrantied time period.

A polyurethane adhesive such as POLYPRO AH160™ manufactured by POLYFOAM PRODUCTS, INC. has been used to adhere concrete and clay roofing tiles to underlayment. Yet the possibility of using this adhesive to secure shingle sheets has not been recognized in the roofing industry, and the industry appears to teach away from such a method. In a consensus document entitled FRSA & NTRMA MODEL TILE SPECIFICATIONS, System Three Mortar & Adhesive-Set Tile Applications Only; Mortar or Adhesive-Set Tile Specification, the Sheet Metal and Air Conditioning Contractors Association (FRSA) and the Florida Chapter of the National Tile Roofing Manufacturers Association (NTRMA) illustrate on page 34 the steps of roofing materials application. For securing base ply to plywood the use of roofing nails and flashings is shown, and for securing top ply headlap to base ply the use of asphaltic adhesive, rather than polyurethane adhesive, is shown.

It is thus an object of the present invention to provide a method of securing shingles or shingle sheets to building roofs which requires significantly fewer man hours and consequentially generates lower labor costs than nailing shingles and shingle sheets to roof underlayments.

It is another object of the present invention to provide such a method which fastens the shingles or shingle sheets to an underlayment with greater strength and wind resistance capability than conventional nail attachment methods do.

It is still another object of the present invention to provide such a method which requires minimal skill and which is less dependent for quality outcome upon the diligence and responsibility of the particular workers involved, and thus produces a roof of more reliable quality because shingle mounting essentially is either done right or not done at all.

It is finally an object of the present invention to provide such a method which produces a finished roof which has an attractive appearance and a long life in a wide variety of whether and climate conditions.

SUMMARY OF THE INVENTION

The present invention accomplishes the above-stated objectives, as well as others, as may be determined by a fair reading and interpretation of the entire specification.

A method is provided of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet abutment face and a shingle sheet display face, including the steps of: depositing at least one first anchoring line of the adhesive onto the underlayment substantially parallel to the roof lower edge, the first anchoring line being spaced upwardly from the roof lower edge a distance not more than the shingle sheet width; placing a first series of the shingle sheets onto and in series along the at least one first anchoring line so that the first series of the shingle sheets extend substantially to the roof lower edge; depositing at least one second anchoring line of the adhesive onto the underlayment substantially parallel to the roof lower edge and spaced upwardly from the first series of shingle sheets a distance not more than the shingle sheet width; and placing a second series of the shingle sheets onto and in series along the at least one second anchoring line.

The second series of shingle sheets preferably are placed to overlap the upper ends of the first series of shingle sheets. The method preferably includes the additional steps of depositing a first interconnecting line of the adhesive onto the display faces of the first series of shingle sheets and moving the overlapping second series of shingle sheets into contact with the first interconnecting line. The adhesive preferably is a two component polyurethane adhesive. The method preferably includes the additional step of combining the two components to form the polyurethane adhesive. The shingle sheets preferably are one of: individual shingles, dimensional shingle sheets, and three tab flat shingle sheets.

A method is further provided of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet abutment face and a shingle sheet display face, including the steps of: depositing a segment of at least one first anchoring line of the adhesive onto each of the abutment faces of a first series of shingle sheets; placing a first series of shingle sheets onto the underlayment substantially parallel to the lower edge of a sloped roof so that the segments of the at least one first anchoring line of adhesive interconnect the first series of shingle sheets and the underlayment and so that the first series of shingle sheets extend substantially to the roof lower edge; depositing a segment of at least one second anchoring line of the adhesive onto each of the shingle sheet abutment faces of a second series of shingle sheets; and placing a second series of shingle sheets onto the underlayment so that the segments of the at least one second anchoring line of adhesive interconnect the second series of shingle sheets and the underlayment, and so that the second series of shingle sheets are substantially parallel to the roof lower edge. The second series of shingle sheets once again are preferably placed to overlap and extend upwardly from the first series of shingle sheets.

A method is still further provided of placing and securing shingle sheets onto a roof underlayment of a sloped roof having a roof lower edge, the shingle sheets each having a shingle sheet width, a shingle sheet length, a shingle sheet upper end and a shingle sheet lower end, a sheet abutment face and a sheet display face, including the steps of: depositing at least one first array of adhesive paddies onto the underlayment substantially parallel to the roof lower edge, the first array of adhesive paddies being spaced upwardly from the roof lower edge a distance not substantially more than the shingle sheet width; placing a first series of shingle sheets onto the at least one first array of adhesive paddies so that the first series of the shingle sheets extend substantially to the roof lower edge; depositing at least one second array of adhesive paddies onto the underlayment substantially parallel to the roof lower edge and spaced upwardly from the first series of shingle sheets a distance substantially not more than the shingle sheet width; and placing a second series of shingle sheets onto the at least one second array of paddies of adhesive.

The second series of shingle sheets once again are preferably placed to overlap and extend upwardly from the upper ends of the first series of shingle sheets. The method preferably includes the additional step of depositing a first interconnecting array of adhesive paddies onto the display faces of the first series of shingle sheets and moving the overlapping second series of shingle sheets into contact with the first interconnecting array of adhesive paddies. The adhesive preferably is a two component polyurethane adhesive. The method preferably includes the additional step of combining the two components to form the polyurethane adhesive. The shingle sheets preferably are one of: individual shingles, dimensional shingle sheets, and three tab flat shingle sheets.

A method is yet further provided of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet abutment face and a shingle sheet display face, including the steps of: depositing a segment of at least one first array of adhesive paddies onto each of the abutment faces of a first series of shingle sheets; placing a first series of shingle sheets onto the underlayment substantially parallel to the roof lower edge so that the segments of the at least one first array of adhesive paddies interconnect the first series of shingle sheets and the underlayment and so that the first series of shingle sheets extend substantially to the roof lower edge; depositing a segment of at least one second array of adhesive paddies onto each of the shingle sheet abutment faces of a second series of shingle sheets; placing a second series of shingle sheets onto the underlayment so that the segments of the at least one second array of adhesive paddies interconnect the second series of shingle sheets and the underlayment, so that the second series of shingle sheets is substantially parallel to the roof lower edge. The second series of shingle sheets preferably are placed to overlap and extend upwardly from the first series of shingle sheets. One segment optionally includes either one adhesive paddy, or at least two adhesive paddies.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
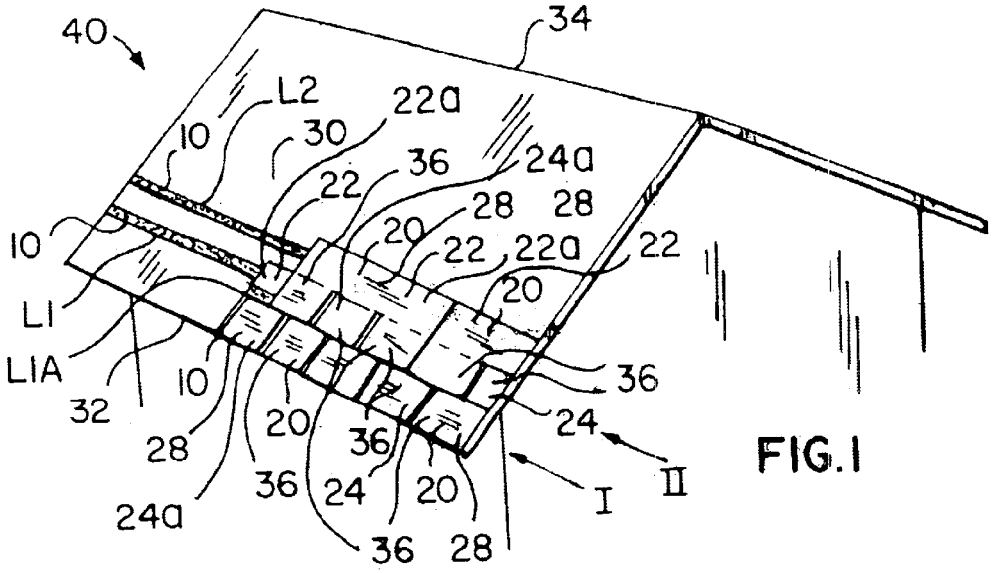
FIG. 1 is a perspective view of an upper end of a building having a peaked roof, illustrating overlapping first and second series of shingle sheets laterally staggered to the preferred extent (to one-half the width of one shingle simulating flap) and secured respectively with first and second anchoring lines of adhesive applied to the building roof underlayment, and also illustrates a first interconnecting line of adhesive applied to the first series display faces and interconnecting the first series upper ends and the second series lower ends.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Method

Figure 2:
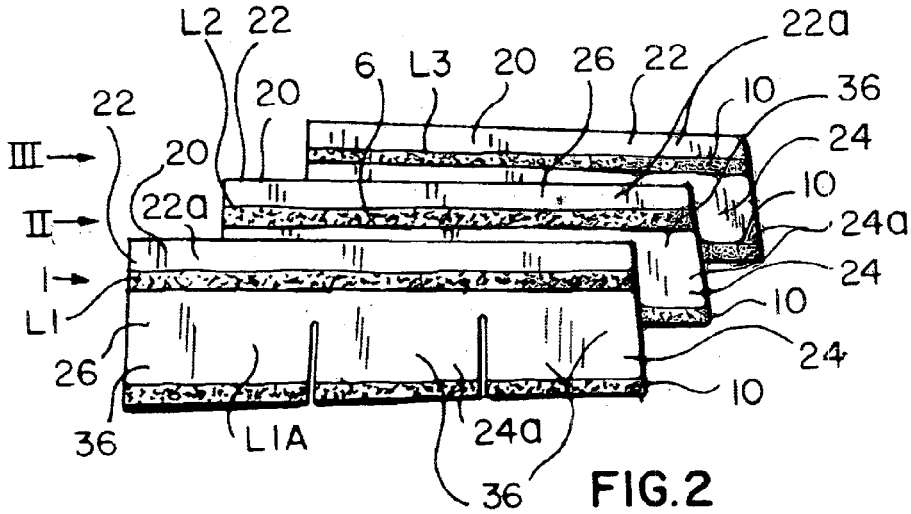
FIG. 2 is a plan view of the abutment faces of three shingle sheets positioned as portions of three overlapping series of shingle sheets, showing the alternative method of applying anchoring line segments applied to the abutment faces of the shingle sheets for connecting the shingle sheets to the roof underlayment, and applying segments of interconnecting lines of adhesive to the abutment faces of the shingle sheets for interconnecting the overlapping series of shingle sheets.
Figure 3:
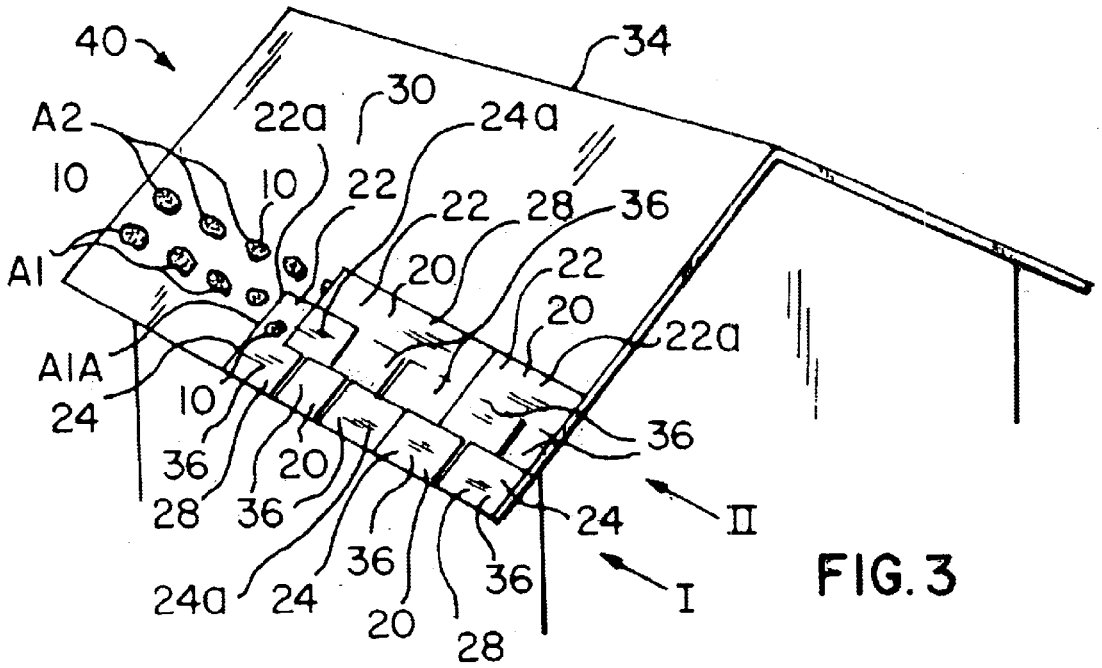
FIG. 3 is a view as in FIG. 1 illustrating overlapping first and second series of shingle sheets secured respectively with first and second arrays of adhesive paddies applied to the building roof underlayment, and also illustrates a first interconnecting array of adhesive paddies applied to the first series display faces and interconnecting the first series upper ends and the second series lower ends.
Figure 4:
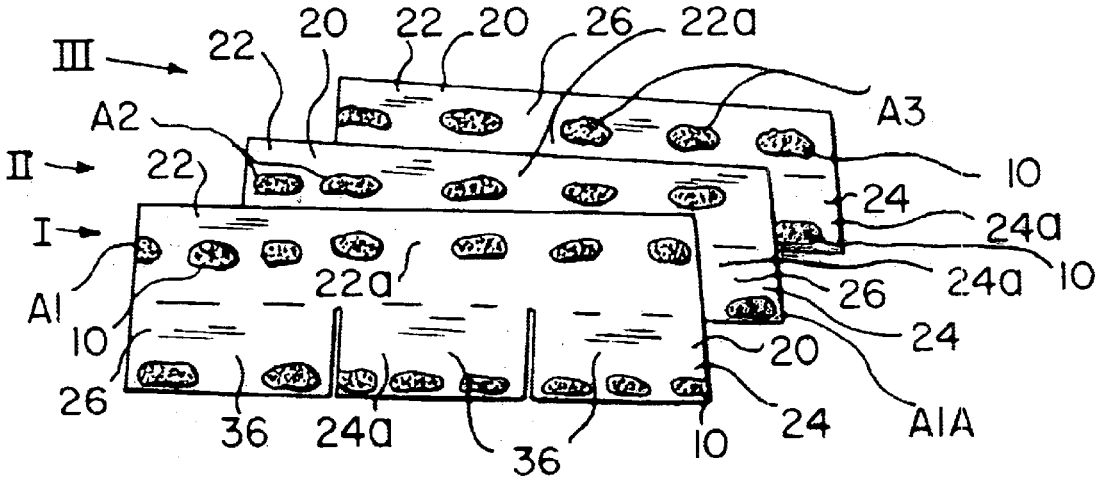
FIG. 4 is a plan view of the abutment faces of three shingle sheets positioned as portions of three overlapping series of shingle sheets, showing the alternative method of applying one or more adhesive paddies to the abutment faces of the shingle sheets for connecting the shingle sheets to the roof underlayment, and applying one or more adhesive paddies to the abutment faces of the shingle sheets for interconnecting the overlapping series of shingle sheets.
Figure 5:
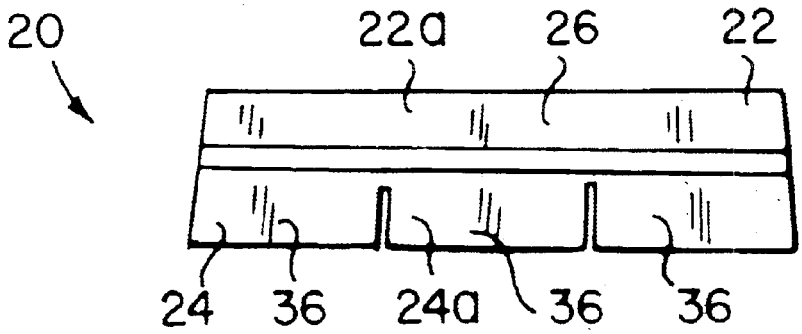
FIG. 5 is a plan view of the abutment face of a typical dimensional shingle sheet.
Figure 6:
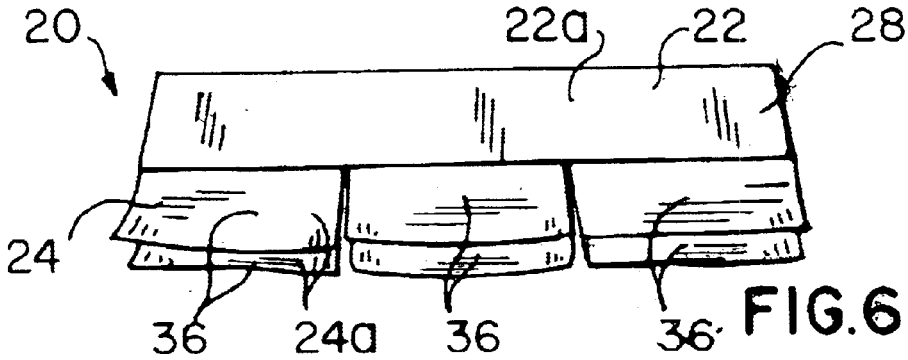
FIG. 6 is a plan view of the display face of a typical dimensional shingle sheet, showing outward shingle simulating flaps at the sheet lower end elevated to reveal the corresponding inward shingle simulating flaps.
Figure 7:
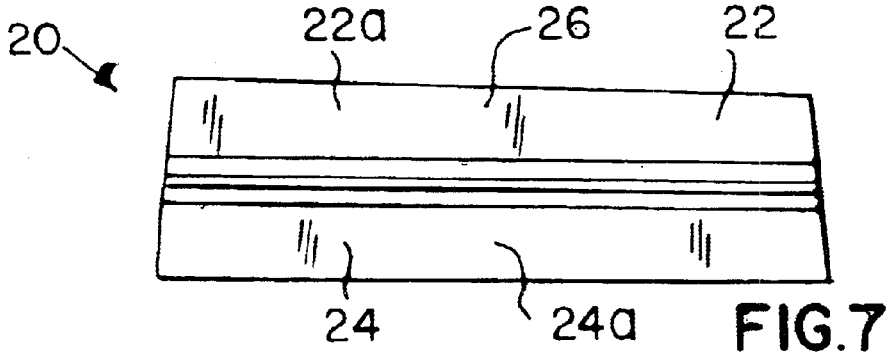
FIG. 7 is a plan view of the abutment face of a three tab flat shingle sheet.
Figure 8:
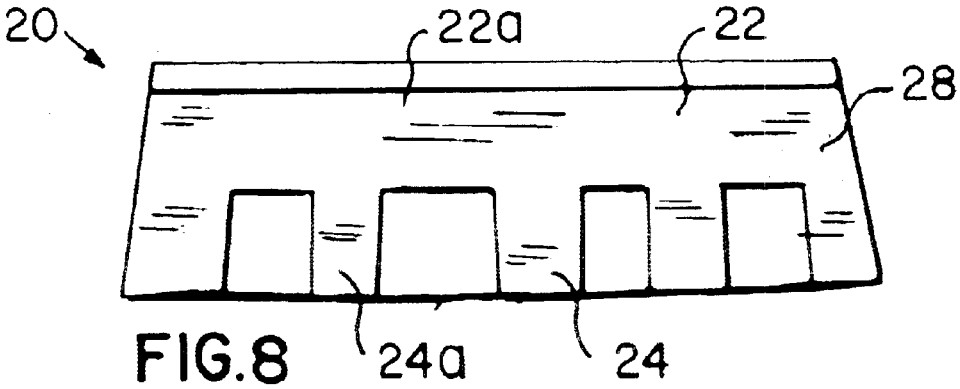
FIG. 8 is a plan view of the display face of a three tab flat shingle sheet.

Referring to FIGS. 1–8, a method of placing and securing shingle sheets 20 to a roof underlayment 30 is disclosed using a polyurethane adhesive 10 rather than nails, resulting in stronger attachment and permitting more rapid, efficient and reliable installation. For purposes of this application the term "shingle sheet" is understood to be inclusive of both individual shingles and contiguous groups of shingles, and the term "sloped roof" 40 is understood to be inclusive of both simple sloped roofs and peaked roofs. The shingle sheets 20 are understood to have upper ends 22 and lower ends 24, abutment faces 26 and display faces 28, upper half portions 22*a* and lower half portions 24*a*.

The preferred method of installing shingle sheets 20 onto a sloped roof 40, such as a peaked roof, includes the steps of depositing at least one first anchoring line L1 of the adhesive 10 onto the underlayment 30 substantially parallel to the roof lower edge 32, the first anchoring line L1 being spaced upwardly from the roof lower edge 32 along underlayment 30 a distance less than the width of one of the shingle sheets 20; placing a first series I of shingle sheets 20 laterally adjacent to or overlapping each other firmly onto the at least one first anchoring line L1 of adhesive 10 so that these shingle sheets 20 extend substantially to the roof lower edge 32; depositing at least one second anchoring line L2 of adhesive 10 onto the underlayment 30 substantially parallel to the roof lower edge 32, and spaced upwardly from the first series I of shingle sheets 20 a distance less than the width of one of the shingle sheets 20; placing second series II of shingle sheets 20 a laterally adjacent to or overlapping each other firmly onto the at least one second anchoring line L2 of adhesive 10 so that the second series II of shingle sheets 20 overlaps upper ends 22 of the first series I of shingle sheets 20. See FIG. 1. A first interconnecting line L1A of adhesive 10 preferably is deposited onto the upper ends 22 of the first series I so that the overlapping portions of the second series II lower ends 24 are adhered to the first series I upper ends 22. The second series II preferably is staggered relative to the first series I. The second step of securing additional series I-n of shingle sheets 20 is repeated until the roof 40 is entirely covered from the roof lower edge 42 to the roof peak or upper edge 34 with multiple series of shingle sheets 20.

It is preferred that the adhesive 10 be deposited in anchoring lines L1–Ln because maximum adhesion is achieved. The anchoring lines L1–Ln may be straight, wavy, angled or curved, as desired. Alternatively, arrays A1–An of discrete paddies of adhesive 10 are deposited onto the underlayment 30, in place of the lines L1 of adhesive 10. See FIG. 3. The paddy array A1–An may be linear or may be scattered or randomly located over the entire sheet 20 coverage area of the underlayment 30. Interconnecting arrays A1A–A1*n* preferably are also provided between first series I upper ends 22 and second series II lower ends 24.

An alternative method is to deposit segments of the first anchoring line L1 or to deposit the first array A1 of adhesive paddies onto the first series I abutment faces 26, rather than or in addition to depositing the first anchoring line L1 or first array A1 of adhesive paddies onto the underlayment 30. By the same token, the alternative method preferably includes the step of depositing the second anchoring line L1 or second array A2 of adhesive paddies onto the second series II abutment faces 26, rather than or in addition to depositing the second anchoring line L2 or second array A2 of paddies onto the underlayment 30. Interconnecting arrays A1A–A1*n* may be applied to display faces 28 or to abutment faces or to both, to position the paddies between overlapping series upper ends 22 and series lower ends 24.

Typical examples of shingle sheets 20 for which the method is specifically intended are dimensional shingle sheets and three tab flat shingle sheets, although the method is intended for many other types of shingle sheets and other sheets of individual and collective shingles as well. The dimensional shingle sheets and three tab shingle sheets include slits at the sheet lower ends 24 defining shingle simulating flaps 36. The preferred polyurethane adhesive 10 is a foam adhesive known as POLYPRO AH160™, which is manufactured by POLYFOAM PRODUCTS, INC. and is a two component polyurethane adhesive 10 for depositing in paddies onto hot mopped 30/90 roof underlayment systems to adhere specific concrete and clay roofing tiles produced by certain manufacturers. The two components are marketed under the trade names PROPACK 30™ and PROPACK 100™, which are combined to form POLYPRO AH160™ and are dispensed using the POLYFOAM FOAMPRO™ RTF1000 dispensing system.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet upper half portion and a shingle sheet lower half portion, a shingle sheet abutment face and a shingle sheet display face, comprising the steps of:

depositing at least one first anchoring line of adhesive onto the underlayment substantially parallel to the roof lower edge, the at least one first anchoring line being spaced upwardly from the roof lower edge a distance not more than the shingle sheet width;

placing a first series of the shingle sheets onto and in series along the at least one first anchoring line such that each shingle sheet of the first series of shingle sheets is secured by the first anchoring line;

depositing at least one second anchoring line of the adhesive onto the underlayment substantially parallel to the roof lower edge and spaced upwardly from the first series of shingle sheets a distance not more than the shingle sheet width;

placing a second series of the shingle sheets onto and in series along the at least one second anchoring line such that the abutment face of each shingle sheet upper half portion of the second series of shingle sheets rests on and is secured by the second anchoring line and such that the second series of shingle sheets overlap the upper ends of the first series of shingle sheets;

and depositing a first interconnecting line of the adhesive onto the display faces of the first series of shingle sheets and moving the overlapping second series of shingle sheets into contact with the first interconnecting line.

2. The method of claim 1, wherein the adhesive is a two component polyurethane adhesive.

3. The method of claim 2, comprising the additional step of combining the two components to form the polyurethane adhesive.

4. The method of claim 1, wherein the shingle sheets are one of: individual shingles, dimensional shingle sheets, and three tab flat shingle sheets.

5. A method of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet upper half portion and a shingle sheet lower half portion, a shingle sheet abutment face and a shingle sheet display face, comprising the steps of:

depositing a segment of at least one first anchoring line of adhesive onto each of the abutment faces of a first series of shingle sheets;

placing a first series of shingle sheets onto the underlayment substantially parallel to the lower edge of a sloped roof such that the segments of the at least one first anchoring line of adhesive interconnect the first series of shingle sheets and the underlayment;

depositing a segment of at least one second anchoring line of the adhesive onto each of the shingle sheet abutment faces of a second series of shingle sheets;

placing a second series of shingle sheets onto the underlayment such that the segments of the at least one second anchoring line of adhesive interconnect the second series of shingle sheets and the underlayment, and such that the second series of shingle sheets are substantially parallel to the roof lower edge and such that the abutment face of each shingle sheet upper half portion of the second series of shingle sheets rests on and is secured by the at least one second anchoring line and such that the second series of shingle sheets overlap the upper ends of the first series of shingle sheets;

and depositing a first interconnecting line of the adhesive onto the display faces of the first series of shingle sheets and moving the overlapping second series of shingle sheets into contact with the first interconnecting line.

6. A method of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet upper half portion and a shingle sheet lower half portion, a sheet abutment face and a sheet display face, comprising the steps of:

depositing at least one first array of adhesive paddies onto the underlayment substantially parallel to the roof lower edge, the at least one first array of adhesive paddies being spaced upwardly from the roof lower edge a distance not substantially more than the shingle sheet width;

placing a first series of shingle sheets onto the at least one first array of adhesive paddies;

depositing at least one second array of adhesive paddies onto the underlayment substantially parallel to the roof lower edge and spaced upwardly from the first series of shingle sheets a distance substantially not more than the shingle sheet width;

placing a second series of shingle sheets onto the at least one second array of paddies of adhesive such that the abutment face of each shingle sheet upper half portion of the second series of shingle sheets rests on and is secured by the at least one second array of adhesive paddies and such that the second series of shingle sheets overlap the upper ends of the first series of shingle sheets;

and depositing a first interconnecting array of adhesive paddies onto the display faces of the first series of shingle sheets and moving the overlapping second series of shingle sheets into contact with the first interconnecting array of adhesive paddies.

7. The method of claim 6, wherein the second series of shingle sheets are placed to overlap and extend upwardly from the upper ends of the first series of shingle sheets.

8. The method of claim 7, comprising the additional step of depositing a first interconnecting array of adhesive paddies onto the display faces of the first series of shingle sheets and moving the overlapping second series of shingle sheets into contact with the first interconnecting array of adhesive paddies.

9. The method of claim 6, wherein the adhesive is a two component polyurethane adhesive.

10. The method of claim 9, comprising the additional step of combining the two components to form the polyurethane adhesive.

11. The method of claim 6, wherein the shingle sheets are one of: individual shingles, dimensional shingle sheets, and three tab flat shingle sheets.

12. A method of placing and securing shingle sheets onto a roof underlayment of a sloped roof having a roof lower edge, the shingle sheets each having a shingle sheet width, a shingle sheet length, a shingle sheet upper end and a shingle sheet lower end, a shingle sheet upper half portion and a shingle sheet lower half portion, a shingle sheet abutment face and a shingle sheet display face, comprising the steps of:

depositing a segment of at least one first array of adhesive paddies onto each of the abutment faces of a first series of shingle sheets;

placing a first series of shingle sheets onto the underlayment substantially parallel to the roof lower edge such that the segments of the at least one first array of adhesive paddies interconnect the first series of shingle sheets and the underlayment;

depositing a segment of at least one second array of adhesive paddies onto each of the shingle sheet abutment faces of a second series of shingle sheets;

placing a second series of shingle sheets onto the underlayment such that the segments of the at least one second array of adhesive paddies interconnect the second series of shingle sheets and the underlayment, such that the second series of shingle sheets is substantially parallel to the roof lower edge such that the abutment face of each shingle sheet upper half portion of the second series of shingle sheets rests on and is secured by the at least one second array of adhesive paddies and such that the second series of shingle sheets overlap the upper ends of the first series of shingle sheets;

and depositing a first interconnecting array of adhesive paddies onto the display faces of the first series of shingle sheets and moving the overlapping second series of shingle sheets into contact with the first interconnecting array of adhesive paddles.

13. The method of claim 12, wherein one segment comprises one adhesive paddy.

14. The method of claim 12, wherein one segment comprises at least two adhesive paddies.

* * * * *